US011382478B2

(12) United States Patent
Santini

(10) Patent No.: US 11,382,478 B2
(45) Date of Patent: Jul. 12, 2022

(54) MOBILE FLOOR-CLEANING ROBOT WITH FLOOR-TYPE DETECTION

(71) Applicant: iRobot Corporation, Bedford, MA (US)

(72) Inventor: Fabrizio Santini, Arlington, MA (US)

(73) Assignee: iRobot Corporation, Bedford, MA (US)

( * ) Notice: Subject to any disclaimer, the term of this patent is extended or adjusted under 35 U.S.C. 154(b) by 34 days.

(21) Appl. No.: 17/078,285

(22) Filed: Oct. 23, 2020

(65) Prior Publication Data

US 2021/0052126 A1 Feb. 25, 2021

Related U.S. Application Data

(63) Continuation of application No. 16/005,132, filed on Jun. 11, 2018, now Pat. No. 10,813,518, which is a (Continued)

(51) Int. Cl.

| | |
|---|---|
| ***A47L 11/40*** | (2006.01) |
| ***A47L 9/28*** | (2006.01) |
| ***A47L 9/04*** | (2006.01) |

(52) U.S. Cl.

CPC ..... *A47L 11/4011* (2013.01); *A47L 9/0411* (2013.01); *A47L 9/2826* (2013.01); (Continued)

(58) Field of Classification Search

CPC .. A47L 11/4011; A47L 9/0411; A47L 9/2826; A47L 11/4013; A47L 11/4041; (Continued)

(56) References Cited

U.S. PATENT DOCUMENTS

| | | | |
|---|---|---|---|
| 4,953,253 | A | 9/1990 | Fukuda et al. |
| 4,958,406 | A | 9/1990 | Toyoshima et al. |

(Continued)

FOREIGN PATENT DOCUMENTS

| | | |
|---|---|---|
| CN | 1889882 | 1/2007 |
| CN | 102890500 | 1/2013 |

(Continued)

OTHER PUBLICATIONS

"European Application Serial No. 17168333.7, Response filed Mar. 25, 2021 to Communication Pursuant to Article 94(3) EPC dated Sep. 17, 2020", 11 pgs.

(Continued)

*Primary Examiner* — Andrew A Horton

(74) *Attorney, Agent, or Firm* — Schwegman Lundberg & Woessner, P.A.

(57) ABSTRACT

Cleaning robots may use floor-type-detection techniques as a trigger for autonomously altering various floor-cleaning characteristics. In some examples, a controller circuit of the robot is configured to determine a flooring type as a function of a signal from a motion sensor indicative of a change in pitch caused by the robot crossing a flooring discontinuity. In some examples, the controller circuit is configured to determine a flooring type based on a power draw signal corresponding to the cleaning head assembly of the robot.

20 Claims, 10 Drawing Sheets

Related U.S. Application Data continuation of application No. 14/622,613, filed on Feb. 13, 2015, now Pat. No. 9,993,129.

(52) U.S. Cl.
CPC ..... *A47L 11/4013* (2013.01); *A47L 11/4041* (2013.01); *A47L 11/4044* (2013.01); *A47L 2201/04* (2013.01); *A47L 2201/06* (2013.01)

(58) Field of Classification Search
CPC ..... A47L 11/4044; A47L 2201/04; A47L 2201/06
See application file for complete search history.

(56) References Cited

U.S. PATENT DOCUMENTS

| | | | | |
|---|---|---|---|---|
| 5,086,539 | A | 2/1992 | Rench | |
| 5,255,409 | A * | 10/1993 | Fujiwara | A47L 9/0411 15/319 |
| 5,722,109 | A | 3/1998 | Delmas et al. | |
| 6,389,329 | B1 | 5/2002 | Colens | |
| 6,532,404 | B2 | 3/2003 | Colens | |
| 6,594,844 | B2 | 7/2003 | Jones | |
| 6,690,134 | B1 | 2/2004 | Jones et al. | |
| 6,781,338 | B2 | 8/2004 | Jones et al. | |
| 6,809,490 | B2 | 10/2004 | Jones et al. | |
| 6,965,209 | B2 | 11/2005 | Jones et al. | |
| 7,155,308 | B2 | 12/2006 | Jones | |
| 7,173,391 | B2 | 2/2007 | Jones et al. | |
| 7,188,000 | B2 | 3/2007 | Chiappetta et al. | |
| 7,196,487 | B2 | 3/2007 | Jones et al. | |
| 7,237,298 | B2 | 7/2007 | Reindie et al. | |
| 7,388,343 | B2 | 6/2008 | Jones et al. | |
| 7,389,156 | B2 | 6/2008 | Ziegler et al. | |
| 7,448,113 | B2 | 11/2008 | Jones et al. | |
| 7,571,511 | B2 | 8/2009 | Jones et al. | |
| 7,636,982 | B2 | 12/2009 | Jones et al. | |
| 7,761,954 | B2 | 7/2010 | Ziegler et al. | |
| 9,798,328 | B2 | 10/2017 | Vicenti | |
| 9,993,129 | B2 | 6/2018 | Santini | |
| 10,813,518 | B2 | 10/2020 | Santini | |
| 10,893,788 | B1 | 1/2021 | Santini et al. | |
| 2002/0016649 | A1 | 2/2002 | Jones | |
| 2002/0120364 | A1 | 8/2002 | Colens | |
| 2003/0025472 | A1 | 2/2003 | Jones et al. | |
| 2004/0020000 | A1 | 2/2004 | Jones | |
| 2004/0049877 | A1 | 3/2004 | Jones et al. | |
| 2004/0187457 | A1 | 9/2004 | Colens | |
| 2004/0207355 | A1 | 10/2004 | Jones et al. | |
| 2005/0067994 | A1 | 3/2005 | Jones et al. | |
| 2005/0156562 | A1 | 7/2005 | Cohen et al. | |
| 2005/0166354 | A1 | 8/2005 | Uehigashi | |
| 2005/0204717 | A1 | 9/2005 | Colens | |
| 2007/0266508 | A1 | 11/2007 | Jones et al. | |
| 2008/0077278 | A1 | 3/2008 | Park et al. | |
| 2008/0140255 | A1 | 6/2008 | Ziegler et al. | |
| 2008/0155768 | A1 | 7/2008 | Ziegler et al. | |
| 2008/0307590 | A1 | 12/2008 | Jones et al. | |
| 2010/0049365 | A1 | 2/2010 | Jones et al. | |
| 2010/0132149 | A1 * | 6/2010 | Jeong | A47L 9/2805 15/319 |
| 2010/0257690 | A1 | 10/2010 | Jones et al. | |
| 2010/0257691 | A1 | 10/2010 | Jones et al. | |
| 2010/0263158 | A1 | 10/2010 | Jones et al. | |
| 2011/0004342 | A1 | 1/2011 | Knopow et al. | |
| 2011/0154589 | A1 | 6/2011 | Reindle | |
| 2012/0125363 | A1 | 5/2012 | Kim et al. | |
| 2012/0317744 | A1 | 12/2012 | Gilbert, Jr. et al. | |
| 2014/0100693 | A1 | 4/2014 | Fong et al. | |
| 2014/0166047 | A1 | 6/2014 | Hillen et al. | |
| 2014/0207280 | A1 | 7/2014 | Duffley et al. | |
| 2014/0207282 | A1 | 7/2014 | Angle et al. | |
| 2016/0000288 | A1 | 1/2016 | Soejima | |
| 2016/0103451 | A1 | 4/2016 | Vicenti | |
| 2016/0235270 | A1 | 8/2016 | Santini | |
| 2018/0289231 | A1 | 10/2018 | Santini | |
| 2021/0022579 | A1 | 1/2021 | Santini | |

FOREIGN PATENT DOCUMENTS

| | | |
|---|---|---|
| CN | 102890508 | 1/2013 |
| CN | 105892457 | 3/2020 |
| DE | 102010000573 | 9/2011 |
| DE | 102012100324 | 7/2013 |
| EP | 2457486 | 5/2012 |
| EP | 2661208 | 11/2013 |
| EP | 2741483 | 6/2014 |
| EP | 3058860 | 8/2016 |
| EP | 3058860 | 6/2017 |
| EP | 3219241 | 9/2017 |
| WO | 2014196227 | 12/2014 |
| WO | 2016130188 | 8/2016 |

OTHER PUBLICATIONS

"U.S. Appl. No. 14/622,613, Non Final Office Action dated Sep. 14, 2017", 10 pgs.
"U.S. Appl. No. 14/622,613, Response filed Dec. 14, 2017 to Non Final Office Action dated Sep. 14, 2017", 12 pgs.
"U.S. Appl. No. 14/622,613, Notice of Allowance dated Feb. 16, 2018", 5 pgs.
"U.S. Appl. No. 14/622,613, Supplemental Notice of Allowability dated May 16, 2018", 2 pgs.
"International Application Serial No. PCT US2015 061121, International Search Report dated Feb. 2, 2016", 2 pgs.
"International Application Serial No. PCT US2015 061121, Written Opinion dated Feb. 2, 2016", 5 pgs.
"International Application Serial No. PCT US2015 061121, International Preliminary Report on Patentability dated Aug. 24, 2017", 7 pgs.
"European Application Serial No. 15195610.9, European Search Report dated Jul. 27, 2016", 4 pgs.
"European Application Serial No. 17168333.7, Extended European Search Report dated Jul. 25, 2017", 5 pgs.
"U.S. Appl. No. 16/005,132, Preliminary Amendment filed Jul. 31, 2018", 6 pgs.
"Chinese Application Serial No. 201510507560.0, Office Action dated Jul. 26, 2019", w English translation, 27 pgs.
"Chinese Application Serial No. 201510507560.0, Response filed Oct. 9, 2019 to Office Action dated Jul. 26, 2019", w English claims, 13 pgs.
"European Application Serial No. 15195610.9, Office Action dated Jan. 4, 2017", 7 pgs.
"European Application Serial No. 17168333.7, Response filed Mar. 20, 2018 to Communication Pursuant to Rules 161(1) and 162 EPC dated Sep. 25, 2017", 17 pgs.
"U.S. Appl. No. 16/005,132, Notice of Allowance dated Sep. 8, 2020", 5 pgs.
"U.S. Appl. No. 16/005,132, Corrected Notice of Allowability dated Sep. 21, 2020", 2 pgs.
"European Application Serial No. 17168333.7, Communication Pursuant to Article 94(3) EPC dated Sep. 17, 2020", 3 pgs.
"U.S. Appl. No. 17/036,281, Notice of Allowance dated Dec. 4, 2020", 5 pgs.
LG.com, "Quietly but Thoroughly at Work LG HOM-BOT Square", LG VR6270LVMB-HOM-BOT Vacuum Cleaners-LG Electronic, [Retreived on Oct. 6, 2020], retrieved from the Internet: URL http: www.lg.com ae vacuum-cleaners lg-VR6270LVMB, (2015), 6 pgs.

* cited by examiner

MOBILE FLOOR-CLEANING ROBOT WITH FLOOR-TYPE DETECTION

RELATED APPLICATIONS

This application is a continuation of U.S. patent application Ser. No. 16/005,132, filed Jun. 11, 2018, which application is a continuation of U.S. patent application Ser. No. 14/622,613, filed Feb. 13, 2015, issued on Jun. 12, 2018 as U.S. Pat. No. 9,993,129, the contents of which are hereby incorporated by reference in their entireties.

TECHNICAL FIELD

This disclosure relates to autonomous floor-cleaning robots.

BACKGROUND

A robot is generally an electro-mechanical machine guided by a computer or electronic programming to perform a task. Autonomous robots that perform household functions such as floor cleaning without human interaction are now readily available consumer products. Many cleaning robots have the capability to conduct "cleaning missions," where the robots traverse and simultaneously clean (e.g., vacuum) the floor surface of their environment. The length of the cleaning missions that can be completed by a mobile cleaning robot is typically limited by battery charge.

SUMMARY

In one aspect of the present disclosure, a cleaning robot includes: a chassis; a drive connected to the chassis and configured to drive the robot across a floor surface; a cleaning head assembly coupled to the chassis and positioned to engage the floor surface while the robot is maneuvered by the drive; a motion sensor responsive to changes in pitch, the motion sensor being carried by the chassis; and a controller circuit in communication with the cleaning head assembly and the motion sensor, the controller circuit configured to determine a flooring type associated with a cleaning characteristic of the robot and configured to alter the cleaning characteristic of the robot as a function of a signal from the motion sensor indicative of a change in pitch caused by the robot crossing a flooring discontinuity.

In some embodiments, the cleaning head assembly includes a motorized roller rotatably mounted parallel to the floor surface and configured to contact and agitate the floor surface during use. In some implementations, the motorized roller includes a front roller, and the cleaning head further includes a rear roller rotatably mounted parallel to the floor surface and spaced apart from the front roller by a small elongated gap.

In embodiments, at least one of the front and rear rollers is a compliant elastomeric roller featuring a pattern of chevron-shaped vanes distributed along its cylindrical exterior and the vanes of at least the rear roller make contact with the floor surface along the length of the roller such that the roller experiences a consistently applied friction force during rotation.

In some embodiments, the controller circuit is further configured to: detect a change in pitch of the chassis based on feedback from the motion sensor, the change in pitch caused by the robot crossing a flooring discontinuity; detect a change in operation of the cleaning head assembly; and identify a change in flooring type of the floor surface in response to detecting the change in operation of the cleaning head assembly within a predetermined time of detecting the change in pitch. In some implementations, the controller circuit is configured to detect a change in operation of the cleaning head assembly as a change in resistance to rotation of a motorized roller of the cleaning head. In some applications, the controller circuit is configured to detect a change in resistance to rotation of the roller as a change in power generated by a motor driving the roller. In some embodiments, the controller circuit is configured to monitor motor power as a function of one or more of motor current, battery voltage and motor speed.

In some embodiments, the cleaning robot further includes a cleaning bin carried by the chassis, and a motor driven fan located within the cleaning bin to provide a suction force that pulls debris into the cleaning bin, and altering a cleaning characteristic of the robot includes altering the suction force. In some implementations, altering the suction force includes increasing the suction force in response to an identification by the controller circuit of a change across the flooring discontinuity from a hard floor surface to a soft floor surface. In some implementations, altering the suction force includes decreasing the suction force in response to an identification by the controller circuit of a change across the flooring discontinuity from a soft floor surface to a hard floor surface.

In some embodiments, the motion sensor is a six-axis inertial measurement unit and includes at least one of a three-axis gyroscope and a three-axis accelerometer.

In some embodiments, the controller circuit is configured to identify a change in flooring type across the flooring discontinuity by determining a change in a class of the floor surface. In some implementations, the controller circuit is configured to determine a class of the floor surface based on a signal representing operation of the cleaning head assembly. In some applications, the controller circuit is configured to determine a class of the floor surface by partitioning the signal based on a plurality of predetermined ranges. In some applications, the controller circuit is configured to determine a class of the floor surface based on a probabilistic classifier model. In some embodiments, the controller circuit is configured to alter the probabilistic classifier model in response to a detection of a change in pitch caused by the robot crossing a flooring discontinuity. In some embodiments, altering the probabilistic classifier model includes increasing a probability of a floor-type change. In some embodiments, altering the probabilistic classifier model includes resetting a current floor type. In some embodiments, the probabilistic classifier model includes a Bayesian filter. In some implementations, the controller is configured to suspend re-classification of the floor surface as the robot is driven in an arc by the drive.

In another aspect of the present disclosure a cleaning robot includes: a chassis; a drive connected to the chassis and configured to drive the robot across a floor surface; a cleaning head assembly coupled to the chassis and positioned to engage the floor surface while the robot is maneuvered by the drive; and a controller circuit in communication with the cleaning head assembly. The controller circuit is configured to: determine an initial raw class of the floor surface based on a power draw signal corresponding to the cleaning head assembly; identify a change in the class of the floor surface; and in response to identifying a floor-surface change from the initial raw class of the floor surface, modulating a cleaning characteristic of the robot. Identifying a change in the class of floor surface includes integrating data from a plurality of monitored inputs, the inputs including at least one of: a cleaning head state signal; a motion signal, and an inertial measurement unit (IMU) signal.

In some embodiments, identifying a change in class of the floor surface includes: determining that the robot is turning along a curved path on the floor surface based on the motion signal; and in response to determining that the robot is turning, maintaining the cleaning characteristic at a current state.

In some embodiments, identifying a change in class of the floor surface includes: determining that the robot is rotating in place on the floor surface based on the motion signal; and in response to determining that the robot is rotating and not moving across a floor surface interface, maintaining the cleaning characteristic at a current state. In some implementations, identifying a change in class of the floor surface includes: determining a turning radius of the robot based on the motion signal; and altering the cleaning characteristic in proportion to a magnitude of the turning radius.

In some embodiments, the robot further includes a cleaning bin carried by the chassis, and a motor driven fan located within the cleaning bin to provide a suction force that pulls debris into the cleaning bin, and modulating a cleaning characteristic of the robot includes modulating the suction force.

In some embodiments, integrating data from the plurality of monitored inputs includes calculating a probability that a change in the power draw signal corresponds to a change in the class of the floor surface based on each of the inputs. In some implementations, calculating a probability based on the motion signal includes calculating a probability that the robot is performing at least one of a turn in place and an arched turn. In some implementations, calculating a probability based on the cleaning head state signal includes calculating a probability that a motor driving the cleaning head assembly has stalled.

In some implementations, calculating a probability based on the IMU signal includes calculating a probability that the robot has crossed a flooring discontinuity.

In some embodiments, determining an initial raw class of the floor surface includes determining a most likely floor class based on empirical data stored in computer memory of the controller. In some implementations, determining the most likely floor class includes calculating a posterior probability distribution over a set of predefined floor-type classes based on a plurality of probability density functions stored in the computer memory.

In some embodiments, the cleaning head assembly includes a motorized roller rotatably mounted parallel to the floor surface and configured to contact and agitate the floor surface during use. In some implementations, the motorized roller includes a front roller, and the cleaning head further includes a rear roller rotatably mounted parallel to the floor surface and spaced apart from the front roller by a small elongated gap.

In embodiments, at least one of the front and rear rollers is a compliant elastomeric roller featuring a pattern of chevron-shaped vanes distributed along its cylindrical exterior and the vanes of at least the rear roller make contact with the floor surface along the length of the roller such that the roller experiences a consistently applied friction force during rotation.

The details of one or more embodiments of the invention are set forth in the accompanying drawings and the description below. Other features, objects, and advantages of the invention will be apparent from the description and drawings, and from the claims.

DETAILED DESCRIPTION

Figure 1A:
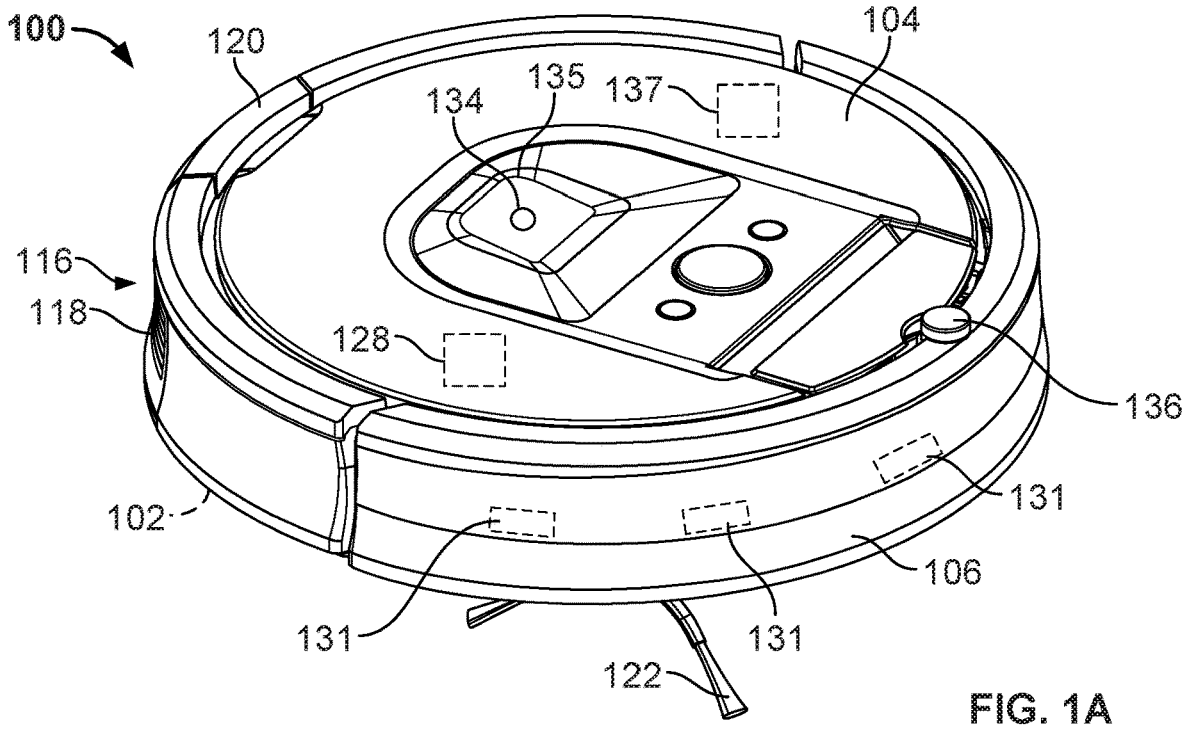
FIG. 1A is a perspective view of a mobile floor cleaning robot.
Figure 1B:
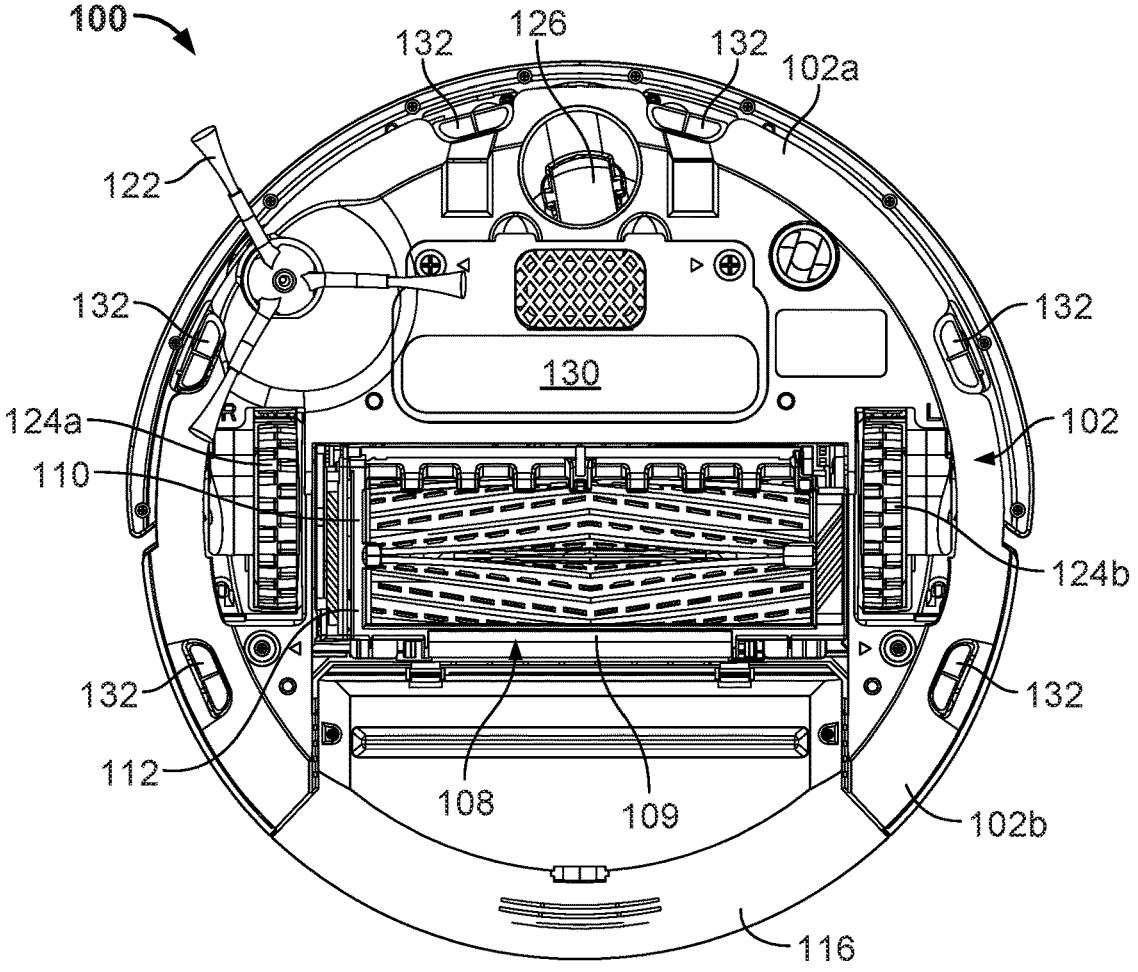
FIG. 1B is a bottom view of the robot of FIG. 1A.
Figure 2A:
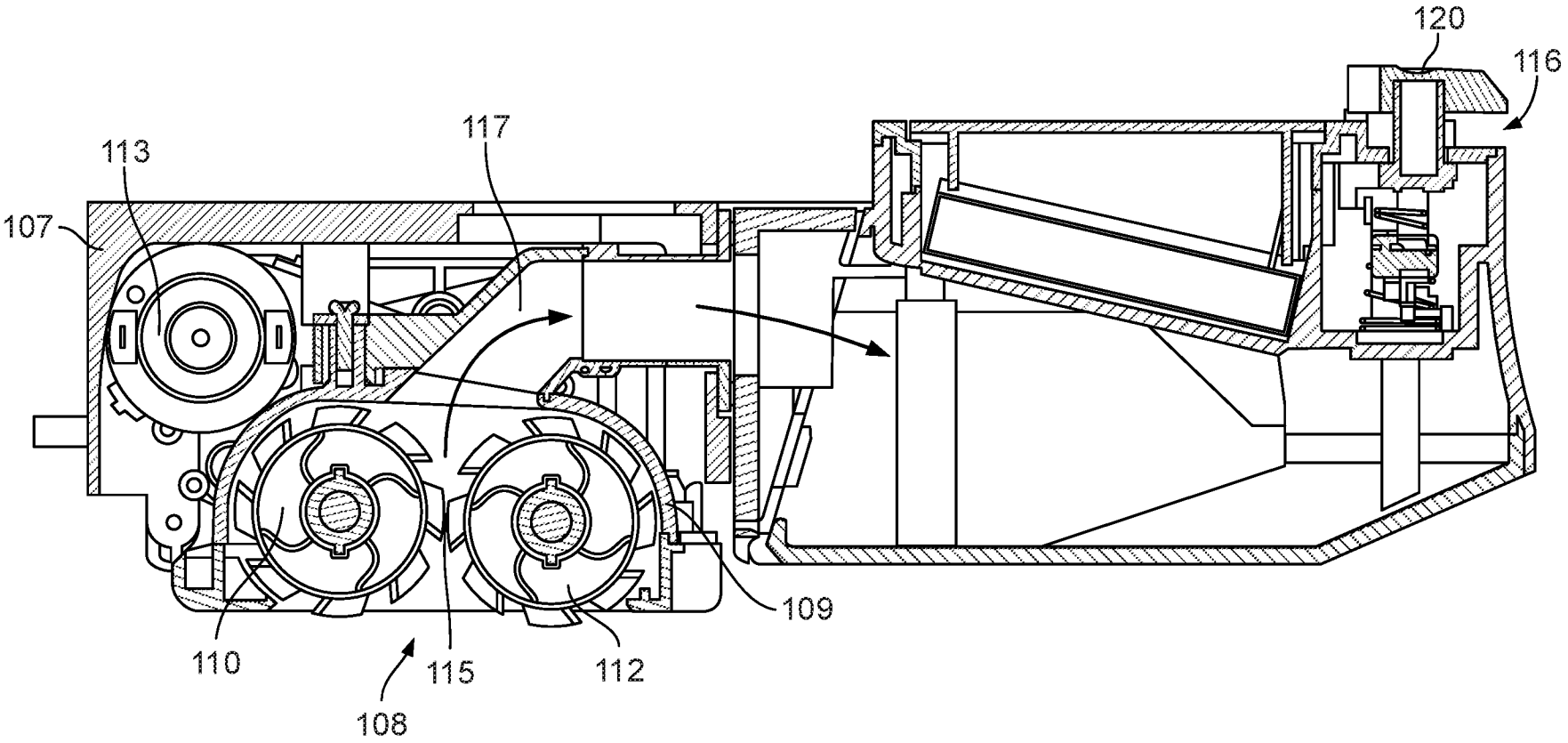
FIG. 2A is a cross-sectional side view of a portion of the mobile floor cleaning robot including a cleaning head assembly and a cleaning bin.
Figure 2B:
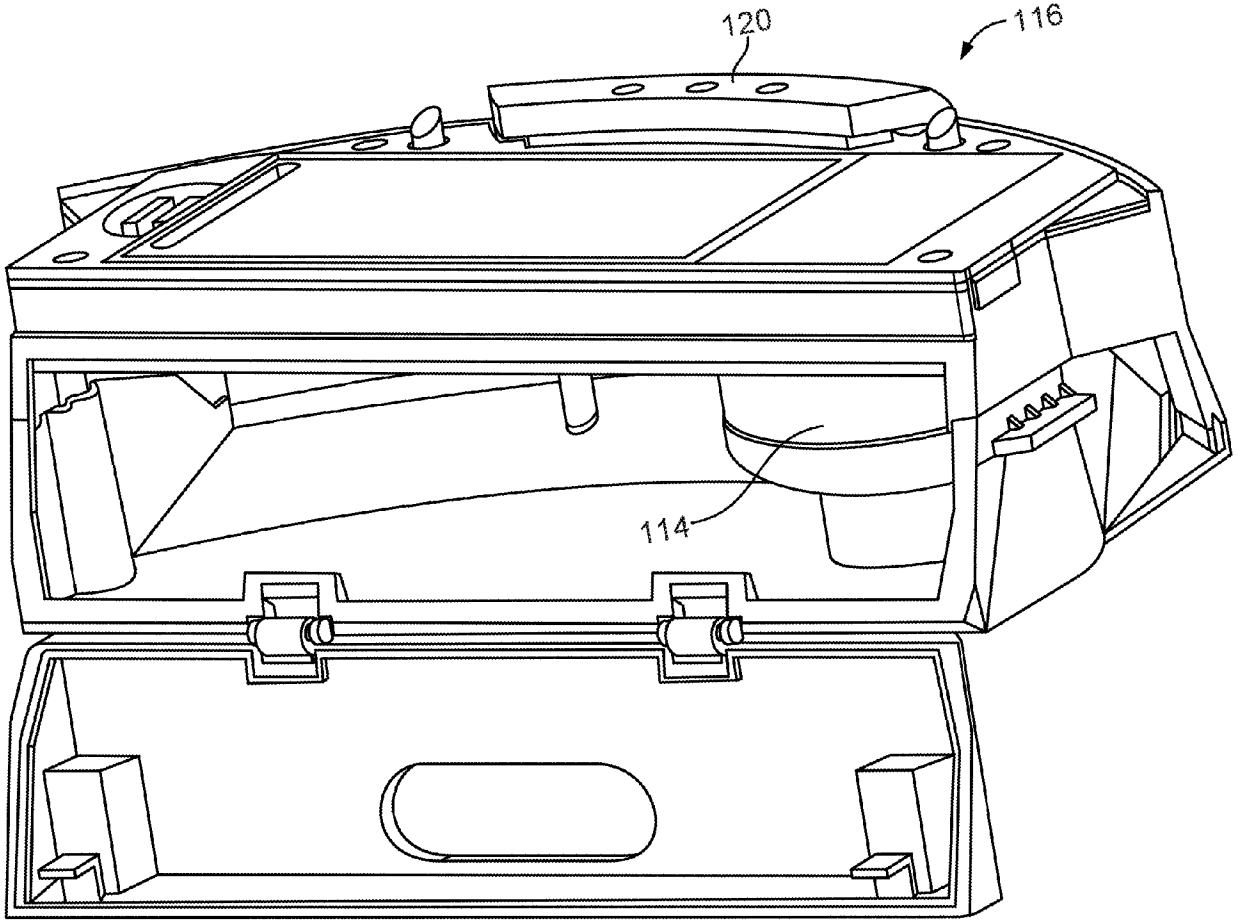
FIG. 2B is a perspective view of the cleaning bin of the cleaning robot.

The present disclosure is related to robotic systems, and particularly mobile cleaning robots. The cleaning robots described below use floor-type-detection techniques as a trigger for autonomously altering various floor-cleaning characteristics. For example, the robot may be configured to detect a change in floor type based on a change in friction between a cleaning element, or other element of the robot, and the floor surfaces on which it travels and simultaneously cleans. A low-friction surface (e.g., a solid surface like hardwood or smooth tile) requires less vacuum suction and would benefit from a different cleaning characteristic than a surface that requires more vacuum suction (e.g. a textured or yielding surface like, textured stone or high pile carpet) indicated by higher sensed friction between the floor surface and the cleaning element. The robot optimizes cleaning results (e.g. increases or decreases the power to the vacuum fan) based on resistance sensed for various flooring types. In some examples, the robot is configured to determine the frictional nature of an interaction between the robot and the floor surface based on a signal corresponding to the power draw of a motor driving a rotating cleaning roller in contact with the surface during cleaning. A relatively high power draw from the motor may indicate high friction, and vice versa.

In some examples, when the floor cleaning robot detects a change from a hard floor surface to a soft floor surface, it automatically increases its vacuum suction to maintain consistent cleaning effectiveness. In the opposite case—a detected change from a soft floor surface to a hard floor surface—the floor cleaning robot may automatically decrease its vacuum suction to optimize mission duration and improving user experience on sound reflective surfaces.

By selectively increasing/decreasing vacuum power, the robot can extend battery life and therefore perform longer cleaning missions between recharging sessions and reduce unnecessary fan motor decibel volume on solid flooring surfaces. Further examples and advantages are provided below with reference to embodiments illustrated by the figures.

FIGS. 1A-2B illustrate an example mobile floor cleaning robot 100, which may be designed to autonomously traverse and clean a floor surface. The robot 100 includes a main chassis 102 for carrying and supporting various functional robotic components described below (e.g., cleaning components, sensors, controllers, etc.). A detachable cover 104 extends across a ceiling of the chassis 102 to protect the robot against damage from solid objects and liquids that may unintentionally be dropped or spilled on top of the robot 100 during use.

The robot 100 may move in both forward and reverse drive directions; accordingly, the chassis 102 has corresponding forward and back ends 102*a*, 102*b*. A bumper 106 is mounted at the forward end 102*a* and faces the forward drive direction. Upon identification of furniture and other obstacles (e.g., via time of flight imaging sensors, camera sensors, sonar, proximity sensors, or other ODOA sensors), the robot 100 can slow its approach and lightly and gently touch the obstacle with its bumper 106 and then selectively change direction to avoid further contact with the obstacle follow along the outer surfaces and/or edges of the obstacle in a wall following routine. In some embodiments, the robot 100 may navigate in the reverse direction with the back end 102*b* oriented in the direction of movement, for example during escape, bounce, and obstacle avoidance behaviors in which the robot 100 drives in reverse.

A cleaning head assembly 108 is located in a roller housing 109 coupled to a middle portion of the chassis 102. The cleaning head assembly 108 is mounted in a cleaning head frame 107 (see FIG. 2A) attachable to the chassis 102. The cleaning head frame 107 couples the roller housing 109 to the chassis 102. In some embodiments, the roller housing 109 is connected to the cleaning head frame 107 by a linkage mechanism that permits the roller housing to move or "float" within the frame as the robot 100 traverses the terrain of a floor surface. Thus, the roller housing 109 carrying the cleaning head assembly 108 moves vertically during operation, for example to accommodate flooring discontinuities while maintaining a consistent ride height of the cleaning head at the flooring surface. U.S. Pub. No. 2012/0317744 (incorporated by reference herein in its entirety) describes a four-bar linkage as a suitable mechanism to support the roller housing 109 within the cleaning head frame 107, allowing the roller housing to move relative to the frame for vertical adjustments during operation of the robotic vacuum, without pivoting in a manner that will cause the roller housing to lose its parallel position with respect to the floor.

The cleaning head assembly 108 includes a front roller 110 and a rear roller 112 rotatably mounted parallel to the floor surface and spaced apart from one another by a small elongated gap. The front 110 and rear 112 rollers are designed to contact and agitate the floor surface during use. In this example, each of the rollers 110, 112 is a compliant elastomeric roller featuring a pattern of chevron-shaped vanes distributed along its cylindrical exterior and the vanes of at least the rear roller make contact with the floor surface along the length of the roller and experience a consistently applied friction force during rotation that is not present with brushes having pliable bristles. Other suitable configurations, however, are also contemplated. For example, in some embodiments, at least one of the front and rear rollers may include bristles and/or elongated pliable flaps for agitating the floor surface.

Each of the front 110 and rear 112 rollers is rotatably driven by a roller motor 113 (see FIG. 2A) to dynamically lift (or "extract") agitated debris from the floor surface. A vacuum source 114 (see FIG. 2B) disposed in a cleaning bin 116 towards the back end 102*b* of the chassis 102 includes a motor driven fan (not shown) that pulls air up through the gap 115 (see FIG. 2A) between the rollers 110, 112 to provide a suction force that assists the rollers in extracting debris from the floor. Air and debris that passes through the roller gap 115 is routed through a plenum 117 (see FIG. 2A) that leads to the interior of the cleaning bin 116. Air exhausted from the vacuum source 114 is directed through an exhaust port 118. In some examples, the exhaust port 118 includes a series of parallel slats angled upward, so as to direct airflow away from the floor. This design prevents exhaust air from blowing dust and other debris along the floor as the robot 100 executes a cleaning routine. The cleaning bin 116 is removable from the chassis 102 by a spring-loaded release mechanism 120.

Installed along the sidewall of the chassis 102, proximate the forward end 102*a* and ahead of the rollers 110, 112 in a forward drive direction, is a motor-driven side brush 122 rotatable about an axis perpendicular to the floor surface. The side brush 122 extends beyond the body of the robot 100 and allows the robot 100 to produce a wider coverage area for cleaning along the floor surface. In particular, the side brush 122 may flick debris from outside the area footprint of the robot 100 into the path of the centrally located cleaning head assembly.

Installed along either side of the chassis 102, bracketing a longitudinal axis of the roller housing 109, are independent drive wheels 124*a*, 124*b* that mobilize the robot 100 and provide two points of contact with the floor surface. The forward end 102*a* of the chassis 102 includes a non-driven, multi-directional caster wheel 126 which provides additional support for the robot 100 as a third point of contact with the floor surface.

A controller circuit 128 (depicted schematically) is carried by the chassis 102. In some examples, the controller circuit 128 includes a printed circuit board (PCB that carries a number of electronic components and computing components (e.g., computer memory and computer processing chips, input/output components, etc.), and is attached to the chassis 102 in the interior compartment below the chassis ceiling. In some embodiments, the controller circuit 128 includes a distributed network of microcontrollers, each microcontroller configured to govern a respective subsystem of the robot 100. The controller circuit 128 is configured (e.g., appropriately designed and programmed) to govern various other components of the robot 100 (e.g., the rollers 110, 112, the side brush 122, and/or the drive wheels 124*a*, 124*b*). As one example, the controller circuit 128 provides commands to operate the drive wheels 124*a*, 124*b* in unison to maneuver the robot 100 forward or backward. As another example, the controller circuit 128 may issue a command to operate drive wheel 124*a* in a forward direction and drive wheel 124*b* in a rearward direction to execute a clock-wise turn. Similarly, the controller circuit 128 may provide commands to initiate or cease operation of the rotating rollers 110, 112 or the side brush 122. For example, the controller circuit 128 may issue a command to deactivate or reverse the rollers 110, 112 if they become entangled. In some embodiments, the controller circuit 128 is designed to implement a suitable behavior-based-robotics scheme to issue commands that cause the robot 100 to navigate and clean a floor surface in an autonomous fashion. The controller circuit 128 is described in greater detail below with reference to the control architecture illustrated in FIG. 3. The controller circuit 128, as well as other components of the robot 100, is powered by a battery system 130 disposed on the chassis 102 forward of the cleaning head assembly 108.

The controller circuit 128 implements the behavior-based-robotics scheme in response to feedback received from a plurality of sensors distributed about the robot 100 and communicatively coupled to the controller circuit 128. For instance, in this example, an array of proximity sensors 131 (depicted schematically in FIG. 1A) are installed along the periphery of the robot 100, including the front end bumper 106. The proximity sensors 131 are responsive to the presence of potential obstacles that may appear in front of or beside the robot 100 as the robot moves in the forward drive direction. The robot 100 further includes an array of cliff sensors 132 installed along the bottom of the chassis 102. The cliff sensors 132 are designed to detect a potential cliff, or flooring drop, as the robot 100 moves in the drive direction (e.g. forwards, backwards, turning, etc.). More specifically, the cliff sensors 132 are responsive to sudden changes in floor characteristics indicative of an edge or cliff of the floor surface (e.g., a descending edge of a stair). In this example, the robot 100 also includes a visual sensor 134 aligned with a substantially transparent window 135 of the protective cover 104. In implementations, the visual sensor 134 is in the form of a digital camera having a field of view optical axis oriented in the forward drive direction of the robot, for detecting features and landmarks in the operating environment and building a virtual map, for example, using VSLAM technology.

In implementations, a beacon communications module 136 is mounted at the forward end 102*a* of the chassis 102 and communicatively coupled to the controller circuit 128. In some embodiments, the beacon communications module is operable to send and receive signals to and from a remote device. For example, the beacon communications module 136 may detect a navigation signal projected from an emitter of a navigation or virtual wall beacon or a homing signal projected from the emitter of a docking station. Docking, confinement, home base, and homing technologies are discussed in U.S. Pat. Nos. 7,196,487; 7,188,000, U.S. Patent Application Publication No. 20050156562, and U.S. Patent Application Publication No. 20140100693 (the entireties of which are hereby incorporated by reference). In this example, the robot 100 further includes a wireless communications module 137. As described in U.S. Patent Publication 2014/0207282 (the entirety of which is hereby incorporated by reference), the wireless communications module 137 (depicted schematically) facilitates the communication of information describing a status of the robot 100 over a suitable wireless network (e.g., a wireless local area network) with one or more mobile devices (e.g., mobile device 900 shown in FIGS. 9A and 9B).

Figure 3:
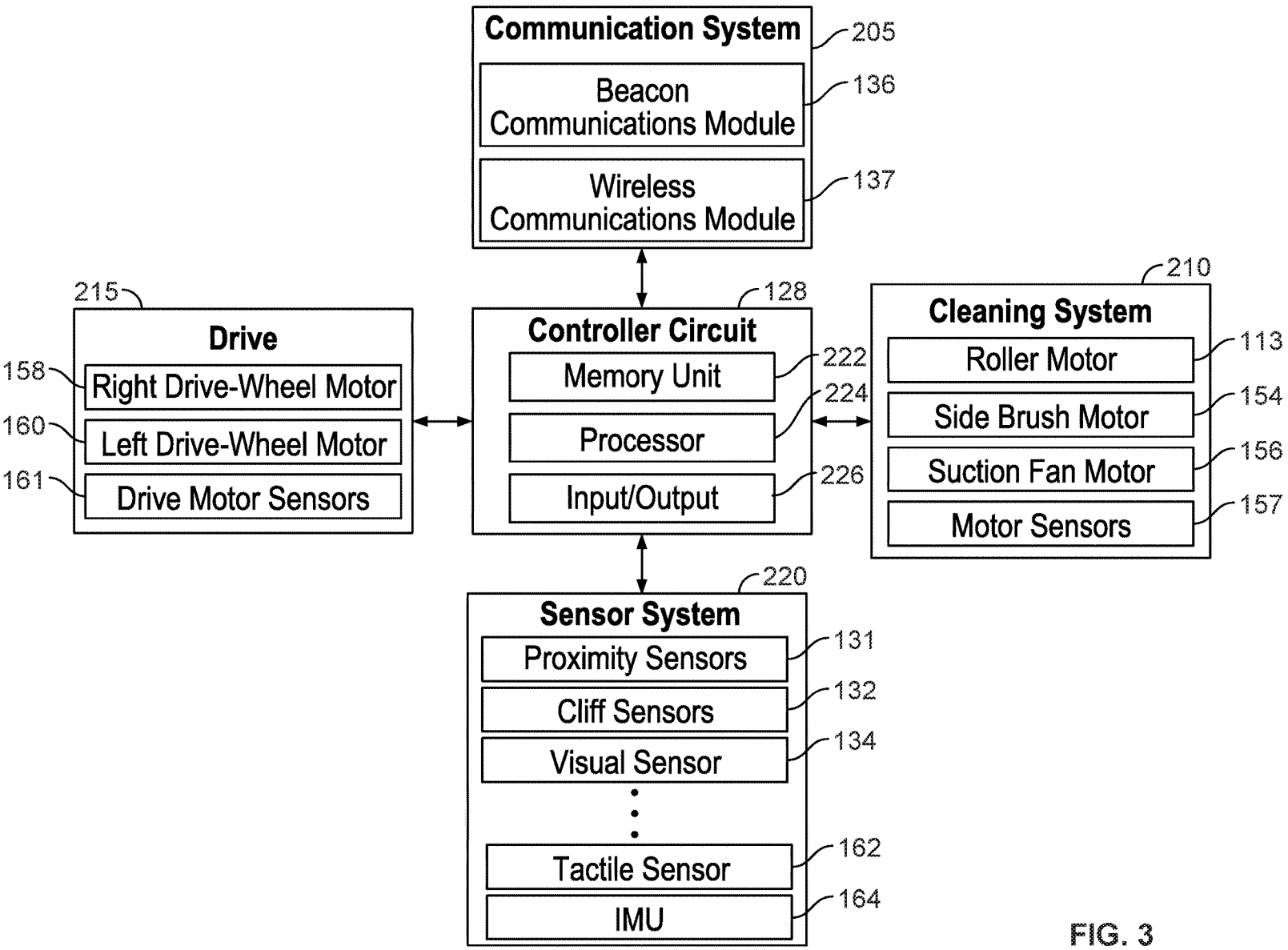
FIG. 3 is a diagram illustrating an example control architecture for operating a mobile floor cleaning robot.

Turning now to FIG. 3, the controller circuit 128 is communicatively coupled to various subsystems of the robot 100, including a communications system 205, a cleaning system 210, a drive system 215, and a navigation sensor system 220. The controller circuit 128 includes a memory unit 222 that holds data and instructions for processing by a processor 224. The processor 224 receives program instructions and feedback data from the memory unit 222, executes logical operations called for by the program instructions, and generates command signals for operating the respective subsystem components of the robot 100. An input/output unit 226 transmits the command signals and receives feedback from the various illustrated components.

In this example, the communications system 205 includes the beacon communications module 136 and the wireless communications module 137, each of which functions as described above. The cleaning system 210 includes the roller motor 113, a side brush motor 154 driving the side brush 122, and a suction fan motor 156 powering the vacuum source 114 in the cleaning bin 116. The cleaning system 210 further includes multiple motor sensors 157 that monitor operation of the roller motor 113, the side brush motor 154, and the suction fan motor 156 to facilitate closed-loop control of the motors by the controller circuit 128. In some embodiments, the roller motor 113 is operated by the controller circuit 128 (or a suitable microcontroller) to drive the rollers 110, 112 according to a particular speed setting via a closed-loop pulse-width modulation (PWM) technique, where the feedback signal is received from a motor sensor 157 monitoring a signal indicative of the rotational speed of the roller motor 113. For example, such a motor sensor 157 may be provided in the form of a motor current sensor (e.g., a shunt resistor, a current-sensing transformer, and/or a Hall Effect current sensor).

The drive system 215 includes a right drive-wheel motor 158 and a left drive-wheel motor 160 for operating the respective drive wheels 124*a*, 124*b* in response to drive commands or control signals from the controller circuit 128, as well as multiple drive motor sensors 161 to facilitate closed-loop control of the drive wheels (e.g., via a suitable PWM technique as described above). In some implementations, a microcontroller assigned to the drive system 215 is configured to decipher drive commands having x, y, and 0 components. The controller circuit 128 may issue individual control signals to the drive wheel motors 158, 160. In any event, the controller circuit 128 can maneuver the robot 100 in any direction across a cleaning surface by independently controlling the rotational speed and direction of each drive wheel 124*a*, 124*b* via the drive wheel motors 158, 160.

Still referring to FIG. 3, the controller circuit 128 operates the drive system 215 in response to signals received from the navigation sensor system 220. For example, the controller circuit 128 may operate the drive system 215 to redirect the robot 100 to avoid obstacles and clutter encountered while treating a floor surface. In another example, if the robot 100 becomes stuck or entangled during use, the controller circuit 128 may operate the drive system 215 according to one or more escape behaviors. To achieve reliable autonomous movement, the navigation sensor system 220 may include several different types of sensors which can be used in combination with one another to allow the robot 100 to make intelligent decisions about a particular environment. In this example, the navigation sensor system 220 includes the proximity sensors 131, the cliff sensors 132 and the visual sensor 134, each of which is described above. The navigation sensor system 220 further includes a tactile sensor 162 responsive to activation of the bumper 106 and an inertial measurement unit (IMU) 164.

The IMU 164 is, in part, responsive to changes in position of the robot 100 with respect to a vertical axis substantially perpendicular to the floor and senses when the robot 100 is pitched at a floor type interface having a difference in height, which is potentially attributable to a flooring type change. In some examples, the IMU 164 is a six-axis IMU having a gyro sensor that measures the angular velocity of the robot 100 relative to the vertical axis. However, other suitable configurations are also contemplated. For example, the IMU 164 may include an accelerometer sensitive to the linear acceleration of the robot 100 along the vertical axis. In any event, output from the IMU 164 is received by the controller circuit 128 and processed (as described below with reference to FIG. 5) to detect a discontinuity in the floor surface across which the robot 100 is traveling. Within the context of the present disclosure the terms "flooring discontinuity" and "threshold" refer to any irregularity in the floor surface (e.g., a change in flooring type or change in elevation at a flooring interface) that is traversable by the robot 100, but that causes a discrete vertical movement event (e.g., an upward or downward "bump"). The vertical movement event could refer to a part of the drive system (e.g., one of the drive wheels 124*a*, 124*b*) or the chassis 102, depending on the configuration and placement of the IMU 164. Detection of a flooring threshold, or flooring interface, may prompt the controller circuit 128 to expect a change in floor type. For example, the robot 100 may experience a significant downward vertical bump as it moves from high pile carpet (a soft floor surface) to a tile floor (a hard floor surface), and an upward bump in the opposite case.

A wide variety of other types of sensors, though not shown or described in connection with the illustrated examples, may be incorporated in the navigation sensor system 220 (or any other subsystem) without departing from the scope of the present disclosure. Such sensors may function as obstacle detection units, obstacle detection obstacle avoidance (ODOA) sensors, wheel drop sensors, obstacle-following sensors, stall-sensor units, drive-wheel encoder units, bumper sensors, and the like.

Figure 4:
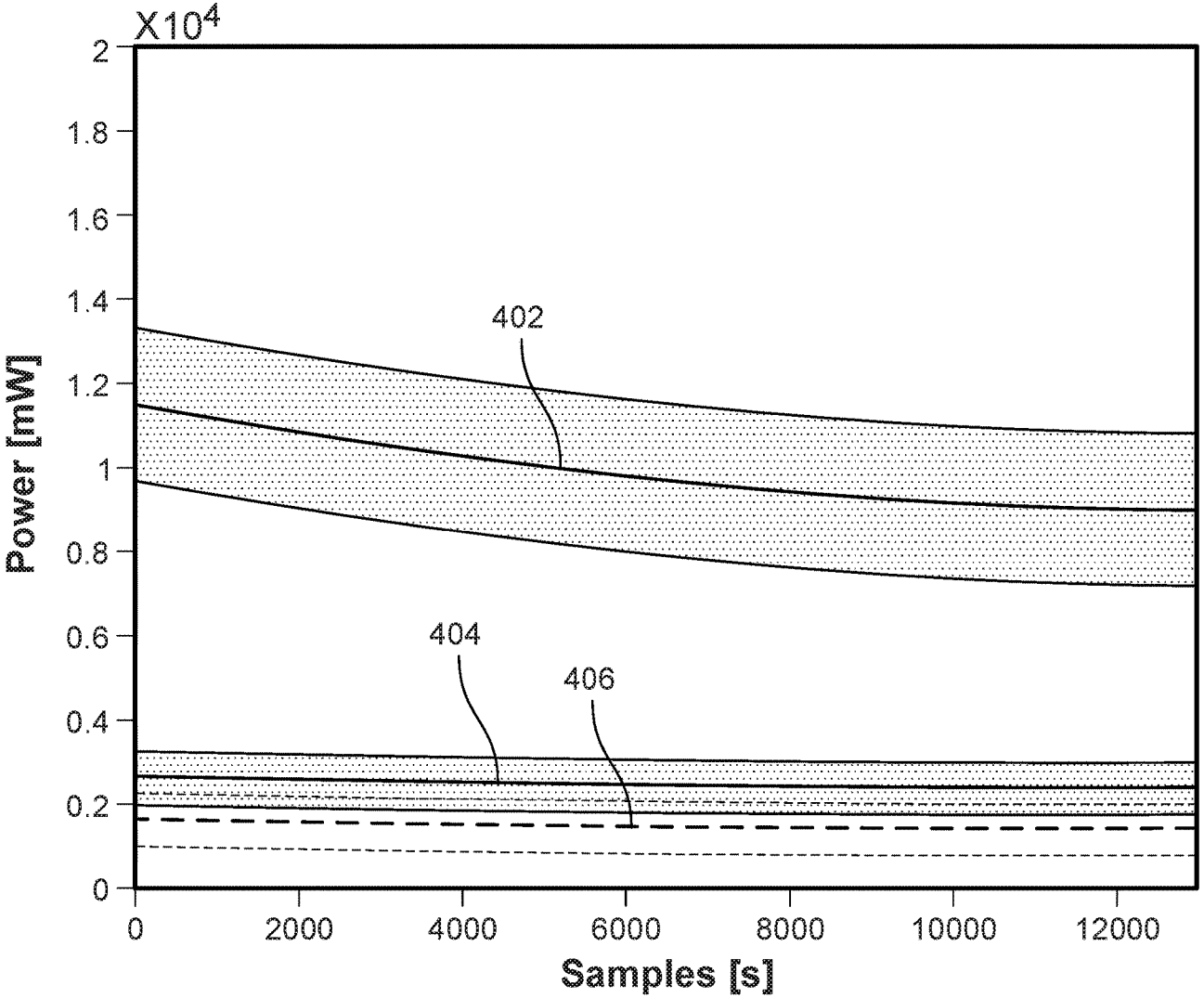
FIG. 4 is a graph illustrating the power consumption of a roller motor over time while cleaning various types of floor surfaces.

The robot 100 can be configured to detect a change in floor type based on the frictional nature of an interaction between the robot and the floor. As noted above, the roller motor 113 is operated to drive the rollers 110, 112 according to a particular speed setting via a closed-loop PWM technique. The PWM is implemented by the controller circuit 128 issuing alternating on/off signals to the roller motor 113. The term "duty cycle" describes the proportion of "on" time to the regular interval or "period" of time; a low duty cycle corresponds to low power draw, because the power is off for most of the time, and vice versa. Frictional losses between the rollers 110, 112 and the floor surface may cause the controller circuit 128 to increase the duty cycle of the PWM to maintain a speed setting. Thus, the frictional nature of a floor surface interaction can be determined based on a signal corresponding to the power draw of the roller motor 113. As shown in the graph of FIG. 4, a high power draw suggests a high friction surface interaction, and a low power draw suggests a low friction surface interaction. In some examples, the power signal can be calculated based on the measured voltage of the battery system 130, the measured current of the roller motor 113, and the PWM control signal characteristics (e.g., the switching frequency and the duty cycle) fed to the roller motor. For instance, the power signal may be calculated as according to the following equation:

Battery Voltage*Motor Current*(measured PWM/max PWM)

The graph 400 of FIG. 4 illustrates multiple power signals observed across 15,000 samples at a rate of 5 ms to 25 ms (e.g., about a 15 sampling rate) while the robot traversed different types of floor surfaces. Note that the power signals of FIG. 4 are plotted as average curves with standard deviation bands. The power signal 402, at an average of between about 11,700 mW and 9,500 mW with about 2,000 mW standard deviation, corresponds to a sample period in which the robot traversed a "soft" surface generating relatively high friction with the cleaning roller. The power signal 404, at an average between about 3,500 mW and 2,000 mW with about 700 mW standard deviation, corresponds to a sample period where the robot traversed a "hard" surface generating relatively low friction with the cleaning roller. The power signal 406, at an average of about 1,800 mW with about 700 mW standard deviation, corresponds to a sample period where the rollers 110, 112 were not in contact with the floor surface traversed by the robot. This condition, where the power drawn by the roller motor is exceptionally low because there are no friction losses at the floor surface, is termed an "under condition." When the cleaning rollers are operating consistently in the under condition, it is likely that they have been worn or damaged. Conversely, a condition where the power drawn by the roller motor is exceptionally high (e.g., above 12,000 mW in this example) is termed an "over condition." When the cleaning rollers are operating in the over condition for an extended time period, it is likely that they have become entangled or otherwise obstructed, which raises the power draw as the controller attempts to operate the roller motor at the established speed setting.

In some examples, the controller circuit 128 distinguishes between different types of floor surfaces (e.g., soft and hard surfaces) and roller conditions (e.g., over and under conditions) based on predetermined power signal ranges stored in the memory unit 222. This approach to signal classification may involve applying parametric estimation techniques to select the predetermined power signal ranges based on historical test data. Floor-type detection based on the predetermined ranges can be executed by the controller circuit 128 with a very simple decision algorithm (e.g., a binary decision tree). However, as shown in the exemplary graph of FIG. 4, the power signal of the roller motor 113 is inherently noisy and there is significant overlap between the signal range observed across the different operational conditions (e.g., hard floor, soft floor, under condition and over condition), which introduces a significant amount of uncertainty to the signal classification process. The noise may be from a number of sources including brushes in the motor, mechanical lag in gear boxes, textures in the floor, manufacturing tolerance, PWM control algorithms, etc. Heavy filtering can be used to process the raw power signal, but may introduce high delays in response time. These delays will impact the sensors' spatial resolution, (e.g. the smallest length of floor that can be classified by floor type). The present invention contemplates overcoming this delay and the noise (which cannot be removed completely by any filter) using machine learning for floor type and providing the robot 100 with learned power distributions for associating a raw power signal with a raw flooring type.

Figure 5:
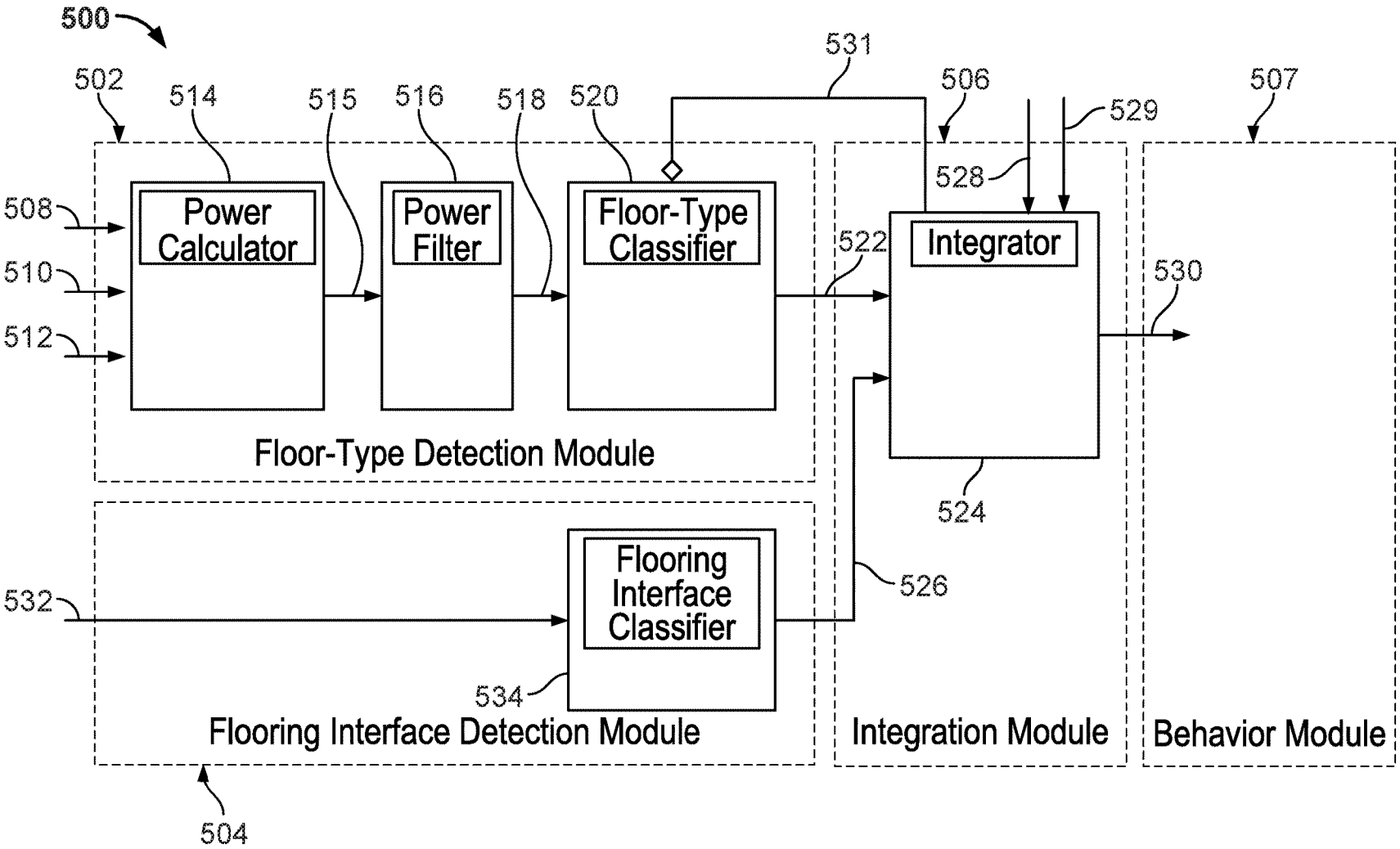
FIG. 5 is a functional diagram illustrating an example protocol for identifying types of floor surfaces.

Turning now to FIG. 5, the functional diagram 500 illustrates a machine-learning approach for implementing floor-type detection by the controller circuit 128. As shown, the functional diagram 500 includes a floor-type detection module 502, a flooring interface detection module 504, an integration module 506, and a behavior module 507, all of which are software modules running on the robot 100 and processed by the controller circuit 128. Data signals 508, 510 and 512 corresponding to the motor current, battery voltage and motor control signals, respectively, are fed into a power calculator 514 of the floor-type detection module 502. The power calculator 514 computes the real-time power draw of the roller motor 113 and feeds the power signal 515 to a power filter 516. The power filter 516 estimates the current value of the power draw given the observation of motor current, battery voltage and motor control signals provided in the data signals 508, 510 and 512. In some examples, the power filter 516 includes a fast Kalman filter, which is a specific type of a Bayesian filter.

Figure 6:
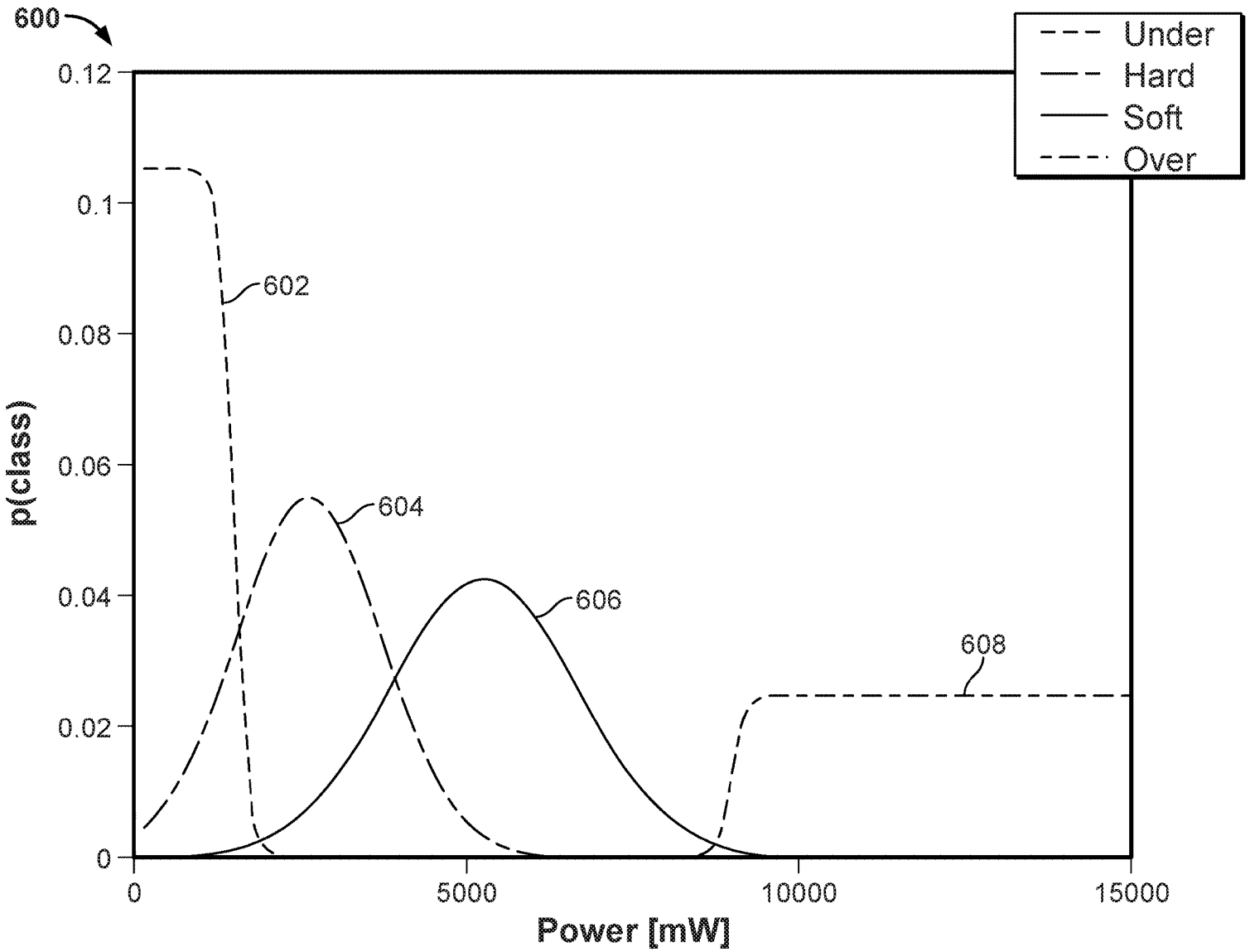
FIG. 6 is a graph illustrating a set of predetermined probability functions for identifying types of floor surfaces according to the diagram of FIG. 5.

The filtered power signal 518 is fed to a floor-type classifier 520 that performs the floor-type classification and feeds a raw floor-type class 522 to an integrator 524 that considers several different robot states in determining whether the floor type class has changed and warranted a change in power to the vacuum fan 114. The raw floor type class is one input to the integrator 524 and is calculated based purely on the filtered power signal (e.g., filtered main roller power level) of the roller motors 113. In some examples, the floor-type classifier 520 is a probabilistic classifier designed to compute a posterior probability distribution over a set of floor-type classes (e.g., hard floor, soft floor, under condition, and over condition) based on the filtered power signal 518. For instance, the floor-type classifier 520 can include a Bayesian filter (also known as a recursive Bayesian estimator) that statistically predicts the current floor type (e.g., hard floor or soft floor) or roller condition (e.g., under condition or over condition) with a calculated level of certainty (e.g., the posterior probability). In some implementations, probability density functions based on empirical data for each floor type and roller condition may be stored in the memory unit 222 of the controller circuit 128 for use in computations by the floor-type classifier 520. The graph 600 of FIG. 6 illustrates a set of probability density functions 602, 604, 606, and 608 that describe the relative likelihood for the floor-type class (a random variable from the perspective of the controller) to take on a given value (e.g., under condition, hard floor, soft floor and over condition) based on the filtered power signal 518. These probability density functions were derived by running thirty robots sampled at random form across a plurality of manufacturing lots on twelve flooring types (e.g. Small tile, medium tile, marble, linoleum, bamboo, oak, laminate, tatami, very low pile carpet, low pile low density carpet, low pile level loop carpet, medium pile carpet, and high pile carpet). The probability density functions are stored in the memory of the robot 100 so that the classifier can determine the probability that a measured power signal falls within one flooring type distribution or another.

Returning back to FIG. 5, in some examples, the floor-type classifier 520 is parameterized conservatively to limit false positive determinations of a change in floor-type, such that only strong evidence of a floor-type change gleaned from the filtered power signal 518 will cause an alteration of the raw floor-type class 522. For instance, the floor-type classifier 520 may abstain from alteration of the raw floor-type class 522 unless the probability of the new class exceeds a relatively high confidence limit (e.g., a posterior probability of about 90%). As another example, the floor-type classifier 520 may be parameterized so as to weigh past evidence of the floor-type more heavily than recent evidence, such that a long-standing floor-type class becomes increasingly more resistant to change.

The integrator 524 receives the raw floor-type class 522 and makes a final floor-type determination 530 in view of one or more additional monitored inputs: a flooring interface signal 526, a motion signal 528, and/or the cleaning head state 529 (e.g. a stall state of the cleaning head roller 110, 112 or an actual measured roller velocity that does not match the commanded velocity). In one implementation, the controller circuit 128 monitors all three additional inputs and ingrates the collective data in making a final floor type determination. The final floor-type determination 530 is received by the behavior module 507 to influence future commands by the controller circuit 128. For example, the controller circuit 128 may alter a cleaning characteristic of the robot 100 based on the final floor-type determination 530, as described below, via a feedback signal 531. In some examples, the integrator 524 performs a second-level floor-type classification (e.g., a probabilistic classification such as Bayesian filtering, simple decision tree, etc.) incorporating each of the raw floor-type class 522, the flooring interface signal 526 and the motion signal 528 to produce the final floor-type determination 530. However, as described below, the integrator 524 may also be configured to effect substantial alterations of the floor-type classifier 520 based on the flooring interface signal 526 and the motion signal 528, and prompt a first-level re-classification of the floor-type.

The flooring interface signal 526 is provided by a flooring interface detection module 504, which is configured to process a data signal 532 from the IMU 164 (e.g., a change in pitch as detected by a gyro in the six-axis IMU) to determine whether the robot 100 has traversed a floor surface threshold, or floor type interface. In implementations, the floor type interface may be a raised doorway threshold or the interface between hardwood flooring and an area rug, for example. Similar to the floor-type detection module 502, the flooring interface detection module 504 may include a flooring interface classifier 534. The flooring interface classifier 534 may include a probabilistic classifier (e.g., a Bayesian filter) that is able to predict a posterior probability distribution over a set of classes (e.g., threshold, or flooring interface, present or threshold not present) based on the motion signal 528. As noted above, detection of a threshold, (or flooring discontinuity, may suggest a change in floor type. Thus, when the flooring interface signal 526 indicates that the robot 100 has traversed a threshold, or flooring discontinuity, the classification process of the integrator 524 is more likely to produce a final floor-type determination 530 that indicates a change in floor type. Further, in some examples, when the flooring interface signal 526 indicates that the robot 100 has traversed a threshold, or flooring discontinuity, the integrator 524 may instigate a change in the floor-type classifier 520 to temporarily override its inherent conservative nature. For instance, the floor-type classifier 520 may be altered to be more liberal by reducing the confidence limit (e.g., decreasing the confidence limit from a posterior probability of about 90% to about 30%) and/or by discounting or expunging past evidence of floor type.

The motion signal 528 includes data describing a motion state of the robot 100 (e.g., speed, orientation etc.), and is considered by the integrator 524 in conjunction with the cleaning head state 529 (e.g. stalled rollers 110, 112, commanded roller velocity vs. measured roller velocity). For instance, the motion signal 528 may include the drive commands used to operate the drive-wheel motors 158, 160. In some examples, the integrator 524 instigates a change in the floor-type classifier 520 based on the motion signal 528 to limit false positive determinations of a floor-type change and/or based on the cleaning head state 529. For instance, the floor-type classifier 520 may be altered to be increasingly conservative when the motion signal 528 indicates the robot 100 is turning in place or gradually turning to trace a curved path or if the rollers 110, 112 are stalled. As one example, the confidence limit of the floor-type classifier 520 may be increased in proportion to the robot's turning radius indicated by the motion signal 528, with a shorter turning radius corresponding to a higher confidence limit, and vice versa. As another example, if the robot 100 is spinning in place, the controller circuit may safely assume that the robot 100 has remained in place and has not moved onto a different flooring type. In implementations, floor-type classification may be temporarily suspended when the turning radius falls below a predetermined turning limit. The threshold for suspending classification is calculated dynamically based on speed of robot 100. To avoid suspending classification at a top speed of (306 mm/sec) the robot 100 turns more tightly (e.g. 2-8 degrees per second and preferably 5 degrees per second). In other implementations, the robot 100 can turn more gradually without suspending floor type classification if robot is moving more slowly.

Once the integrator 524 receives the raw floor-type class 522, the flooring interface signal 526, the motion signal 528, and the cleaning head state 529, the integrator 524 makes a final floor-type determination 530 by adjusting the probability of a flooring type change based on what the motion of the robot 100, cleaning head state of the robot 100 and/or any indication of a threshold or flooring discontinuity as detected by the IMU 164. If the integrator 524 has determined that the floor type has changed, for example from hard flooring to soft flooring, the controller circuit 128 will increase the motor of the fan 114 in the cleaning bin 116 and therefore increase vacuum suction for extracting debris more effectively from carpet pile. If the integrator 524 has determined that floor type has changed for example from a textured or yielding surface flooring to solid a flooring surface, the controller circuit 128 will decrease the motor in the fan 114, quieting the robot 100 and reducing the rate of battery usage because removing debris from a hard floor type requires less suction than extracting debris from the fibers of a carpet, particularly dense and/or high pile carpet.

Figure 7B:
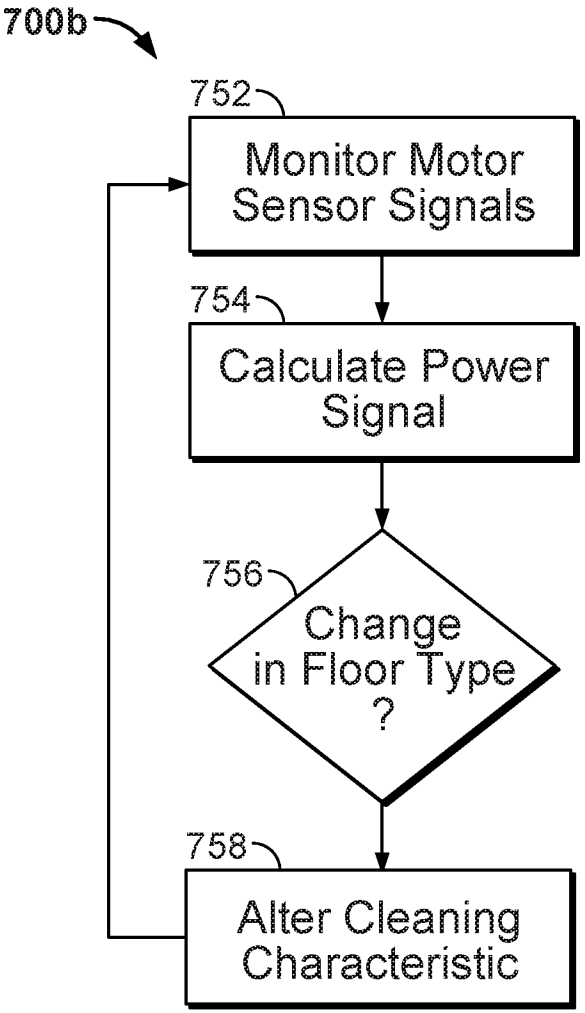
FIG. 7B is a flow diagram illustrating a second method of operating a mobile cleaning robot based on a detected change in floor type.
Figure 7A:
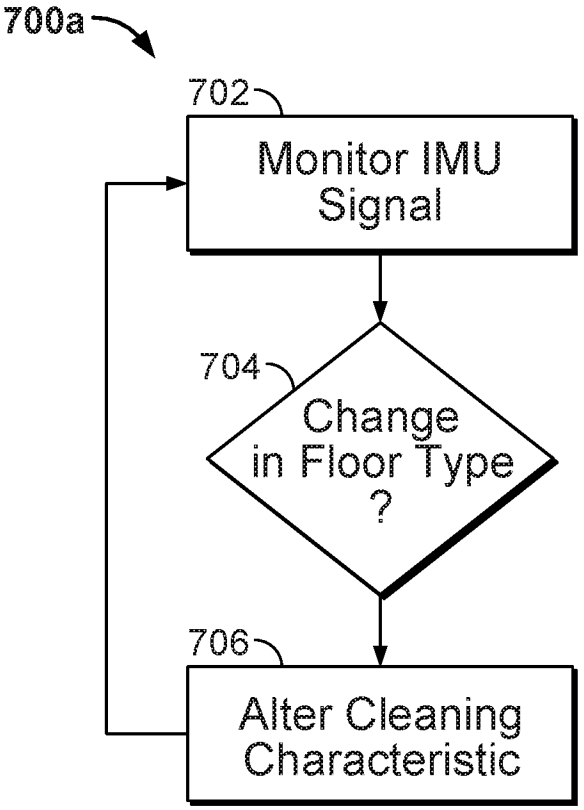
FIG. 7A is a flow diagram illustrating a first method of operating a mobile cleaning robot based on a detected change in floor type.

FIGS. 7A and 7B illustrate exemplary processes 700*a*, 700*b* for operating a mobile cleaning robot 100 in accordance with one or more floor-type detection techniques. The processes 700*a*, 700*b* may be performed by an onboard computing device, e.g., the controller circuit 128 of FIG. 3. Thus, for purposes of illustration, the processes 700*a*, 700*b* will be described as being performed by the controller circuit 128 and various other components of the robot 100.

According to the process 700*a*, the controller monitors (702) multiple sensor signals and power signals to determine a floor type change, including a signal from the IMU 164. The IMU signal may include data describing the angular velocity, or pitch, of the robot 100 relative to a vertical axis (such as may be produced by a gyro sensor of a six-axis IMU), data describing the linear acceleration of the robot 100 along the vertical axis (such as may be produced by an accelerometer of a six-axis IMU) or a combination of such data. The integrator 524 then considers this IMU signal and determines (704) whether there has been a change in floor type based, in part, on the IMU signal indicating that the robot 100 has pitched and/or tilted while driving over a flooring discontinuity or threshold. Thus, in some examples, the controller receives a determination from the integrator 524 that there has been a change in floor type if the IMU signal reflects a magnitude of vertical motion (e.g., an upward or downward pitch, and/or a sideways tilt caused by one drivewheel dropping lower than another) that is greater than a predetermined value indicative of a high probability of change in floor type. In some examples, the controller circuit 128 implements a classification routine (e.g., a Bayesian filter) based on the IMU signal to determine a probability that the robot 100 has traversed a flooring threshold, or flooring discontinuity. In some examples, the controller circuit 128 further monitors a signal from the tactile sensor of the front bumper to determine whether the robot 100 has traversed a flooring threshold or flooring discontinuity, or raised flooring interface between flooring types (e.g. an interface between hard, low pile and soft, high pile). In particular, a detected change in robot pitch without a corresponding sensed contact with an obstacle at the front bumper 106 may serve as a reliable signal of a flooring interface traversal indicative of a potential change in flooring type.

Once the integrator 524 makes a floor type determination, the controller circuit 128 determines (704) whether the floor type has changed and whether to alter (706) a cleaning characteristic of the robot 100. Altering a cleaning characteristic may include altering the speed of the side brush motor powering the side brush 122 and/or altering the speed of the suction fan motor powering the vacuum fan 114 in the cleaning bin. In some examples, the controller circuit 128 may alter a cleaning characteristic of the robot 100 to increase cleaning power (e.g., increasing the motor speed of the side brush 122 and/or increasing the speed of the vacuum fan 114) when the change in floor type is from a hard surface to a soft surface, and decrease cleaning power (e.g., by decreasing the motor speed of the side brush 122 and/or increasing the speed of the vacuum fan 114) when the change in floor type is from a soft or yielding surface to a hard or solid surface. By selectively increasing the cleaning power over a soft or yielding surface, which may be more difficult to clean than a hard or solid surface because of debris entrapped and entangled in long fibers and/or textured crevices, and decreasing the cleaning power over a hard surface, the controller circuit 128 can optimize battery consumption of the robot 100 to increase the length of cleaning missions between recharging sessions. As a further advantage, decreasing the cleaning power as the robot 100 traverses a solid surface may prevent damage to a delicate flooring material (e.g., a tatami floor surface) and/or reduce noise produced by the robot 100 during surface cleaning.

According to the process 700*b*, the controller circuit 128 monitors (752) a plurality of motor sensor signals. The motor sensor signals may include data corresponding to the motor current, battery voltage and control signals of the roller motor. The controller circuit 128 then calculates (754) a power signal based on the motor sensor signals, and determines (756) whether there has been a change in floor type based on the power signal. In some examples, the controller determines that there has been a change in floor type by comparing the power signal to a set of predetermined power signal ranges. In such examples, the controller can positively identify a floor change when the power signal falls within a range corresponding to a floor type that differs from the current floor type. In some examples, the controller implements a classification routine (e.g., a Bayesian filter) based on the power signal to determine a probability that there has been a change in floor type. If the controller determines (756) that there has not been a change in floor type, it resumes monitoring (752) the motor sensor signals. If the controller determines (756) that there has been a change in floor type, it appropriately alters (758) a cleaning characteristic of the robot (as described above), and then resumes monitoring (752) the motor sensor signals.

Figure 8:
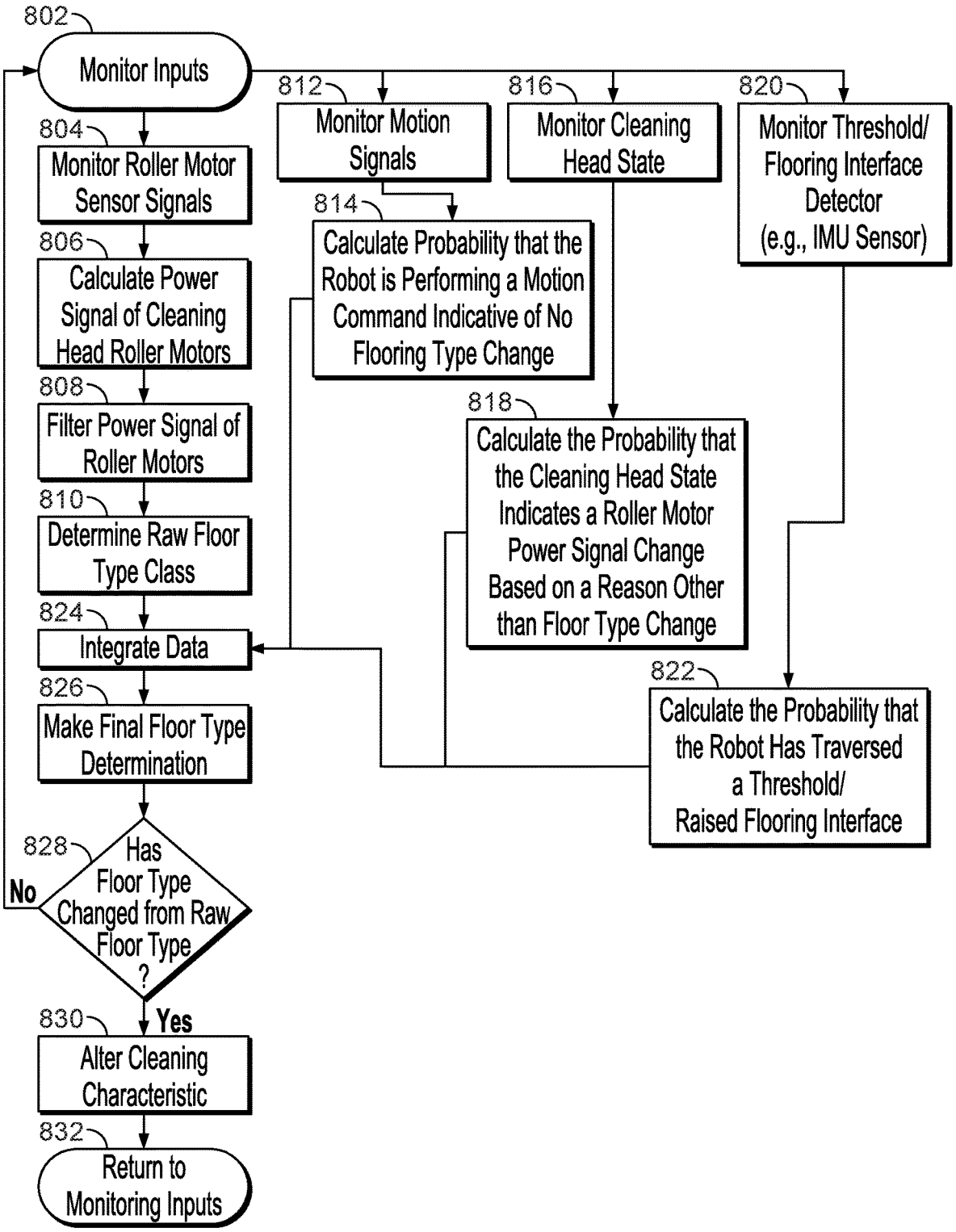
FIG. 8 is a flow diagram illustrating a third method of operating a mobile cleaning robot based on a detected change in floor type.

FIG. 8 illustrates yet another exemplary process 800 for operating a mobile cleaning robot in accordance with the floor-type detection techniques. The process 800 may be performed by an onboard computing device, e.g., the controller circuit 128 of FIG. 3. Thus, for purposes of illustration, the process 800 will be described as being performed by the controller circuit 128 and various other components of the robot 100.

According to the process 800, the controller simultaneously monitors (802) a plurality inputs. The controller circuit 128 monitors a plurality of motor sensor signals (804) that may include data corresponding to the motor current, battery voltage and control signals of the roller motor. The controller then calculates (806) a power signal based on the motor sensor signals, filters (808) the power signal of the roller motors and determines (810) a raw floor-type class based on the power signal. As described above, the controller circuit 128 may determine the raw floor-type class by implementing a probabilistic classification routine (e.g., a Bayesian filter) to compute the posterior probability of the current floor type (e.g., hard floor or soft floor) or roller condition (e.g., under condition or over condition).

The controller circuit also monitors (812) one or more motion signals and calculates (814) the probability that the robot 100 is performing a motion command indicative of no flooring type change, such as a turning in place motion or a tight arcing turn. The controller circuit also monitors (816) the cleaning head state and calculates (818) the probability that the cleaning head state indicates a power signal change based on a reason other than a floor type change, e.g. a roller motor stall or an actual measured roller velocity that does not match the commanded velocity.

The controller circuit 128 also monitors (820) a signal from the IMU 164. The IMU signal may include data describing the angular velocity of the robot 100 relative to a vertical axis (such as may be produced by a gyro sensor detecting a change in pitch of the robot 100), data describing the linear acceleration of the robot 100 along the vertical axis (such as may be produced by an accelerometer) or a combination of such data. The controller circuit 128 then calculates (822) the probability that the robot 100 has traversed a flooring threshold or a raised flooring interface (e.g. an interface between a hard, low pile carpet and a soft, high pile carpet). As described above, the controller may implement a probabilistic classification routine (e.g., a Bayesian filter) based on the IMU signal to calculate a probability that the robot 100 has traversed a flooring threshold or a raised flooring interface.

In one implementation, if the controller circuit 128 determines (810) that the robot has traversed a floor threshold or a raised flooring interface, the integrator 524 considers this in determining whether the floor type has changed and whether the controller circuit 128 needs to alter (812) the floor-type classification routine. For example, the controller circuit 128 may alter the floor-type classification routine to decrease the conservativeness of the routine, such that the classifier is less resistant to change. In another implementation, the controller simultaneously integrates (824) data from one or more of each of the monitored inputs in determining whether the floor type has changed and whether the controller circuit 128 needs to alter the floor-type classification and a cleaning characteristic of the robot 100. In an implementation, the controller circuit 128 simultaneously integrates (824) the raw floor type determination, the calculated probability that the robot 100 is performing a motion command indicative of no flooring type change, the calculated probability that the cleaning head state indicates a roller motor power signal change based on a reason other than floor type change, and the calculated probability that the robot 100 has traversed a threshold/raised flooring interface. In still other implementations, the controller circuit 128 monitors the current draw of the side brush 122 and/or the current draw of the roller motors and compares the data to learned probability distributions associating these current draws with particular flooring types. The controller circuit 128 makes (826) a final floor type determination and considers (828) whether there has been a change in floor type classification based on the integrated data. If the controller circuit 128 determines that there has not been a change in floor type, the controller circuit 128 resumes monitoring (802) inputs. If the controller circuit 128 determines that there has been a change in floor type, it appropriately alters (830) a cleaning characteristic of the robot 100 (as described above), and then resumes (832) monitoring (802) the motor sensor signals.

Returning back to FIG. 3, in some examples the controller circuit 128 is configured to operate the wireless communications module 137 to communicate information describing a status of the robot 100 to a suitable remote mobile device, such as one operated by a user. For example, the controller circuit 128 may operate the wireless communications module 137 to notify a user operating the mobile device that the cleaning rollers 110, 112 are malfunctioning (e.g., the rollers may be worn or entangled). As described above, the controller circuit 128 may determine the condition of the rollers 110, 112 based on a signal corresponding to the power draw of the roller motor 113. For example, when the controller detects an over condition based on the power draw signal, it may determine that the rollers have become entangled; and when the controller detects an under condition, it may determine that the rollers are worn or damaged. The suitable mobile device may be any type of mobile computing device (e.g., mobile phone, smart phone, PDA, tablet computer, or other portable device), and may include, among other components, one or more processors, computer readable media that store software applications, input devices (e.g., keyboards, touch screens, microphones, and the like), output devices (e.g., display screens, speakers, and the like), and communications interfaces.

Figure 9A:
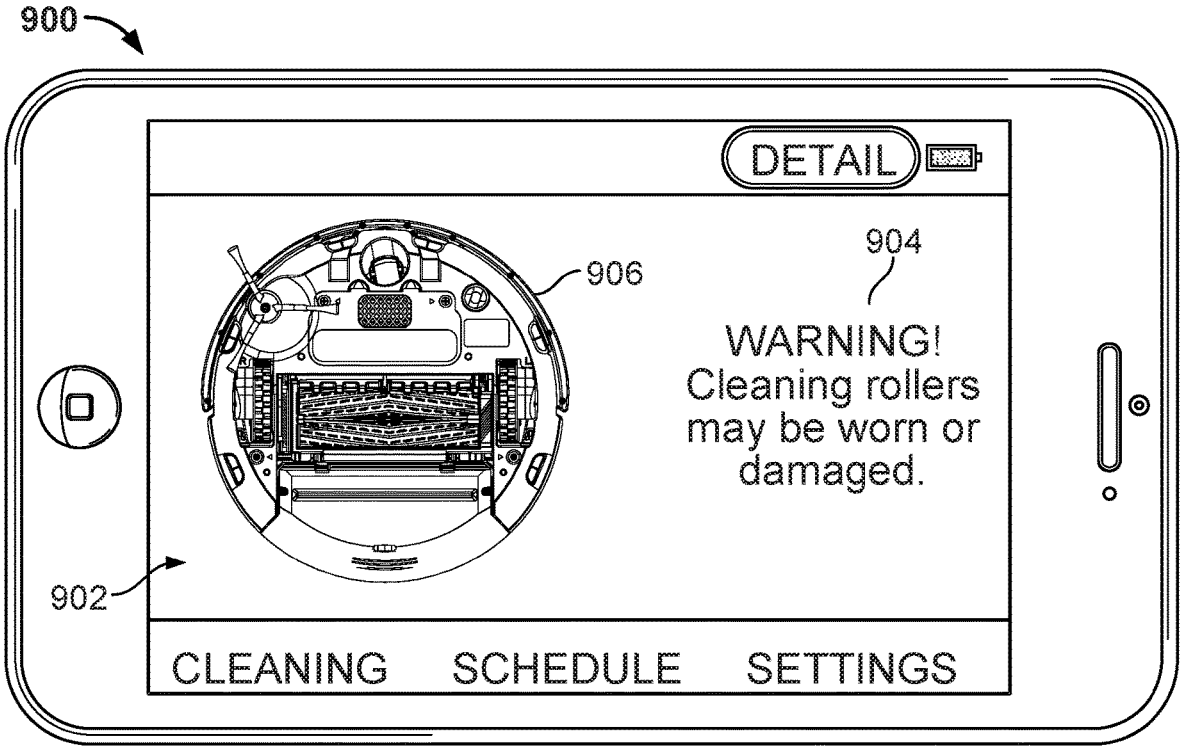
FIGS. 9A and 9B are plan views of a mobile device executing a software application displaying information related to operation of a mobile cleaning robot.
Figure 9B:
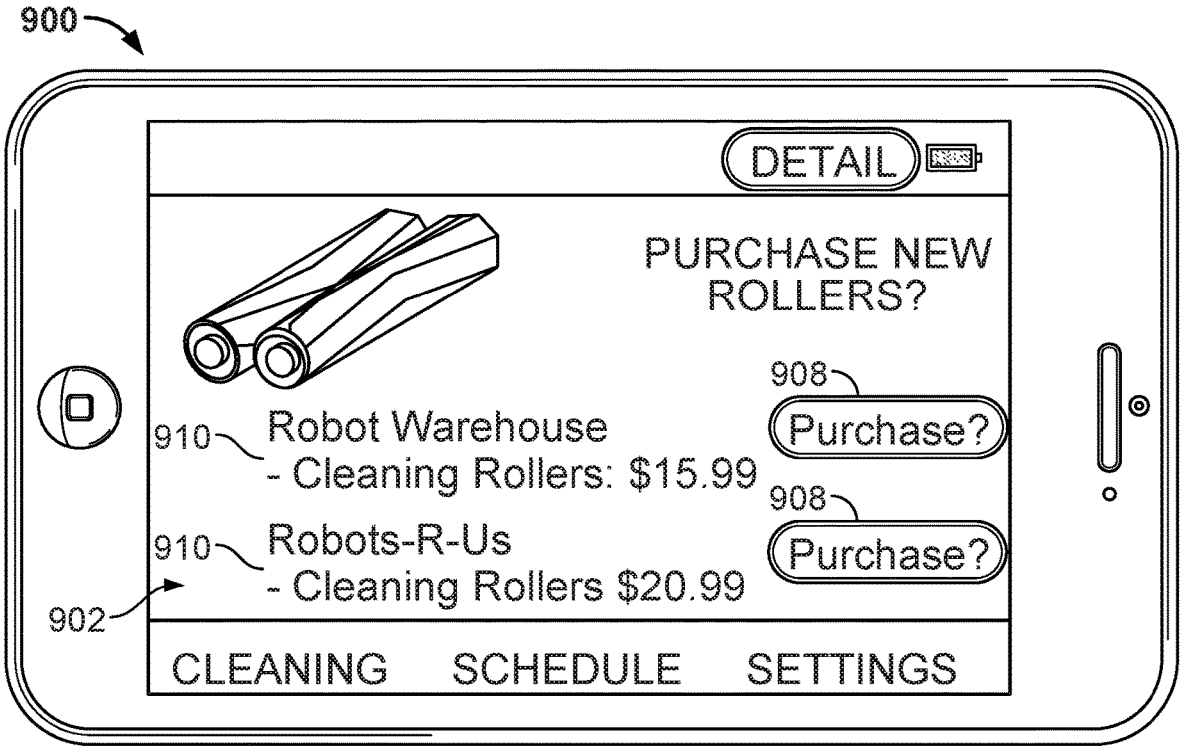

In the example depicted at FIGS. 9A-9C, the mobile device 900 is provided in the form of a smart phone. As shown, the mobile device 900 is operable to execute a software application that displays status information received from the robot 100 on a display screen 902. In FIG. 9A, a warning that the cleaning rollers 110, 112 may be worn or damaged is presented on the display screen 902 via both textual 904 and graphical 906 user-interface elements. Similar user-interface elements may be deployed on the display screen 902 to indicate that the rollers 110, 112 have become entangled. Further, in FIG. 9B, the display screen 902 provides one or more "one click" selection options 908 for purchasing new cleaning rollers to replace the current set that are no longer functioning properly. Further, in the illustrated example, textual user-interface elements 910 present one or more pricing options represented along with the name of a corresponding online vendor.

In the foregoing examples, the software application executed by the mobile device 900 is shown and described as providing alert-type indications to a user that maintenance of the robot 100 is required. However, in some examples, the software application is configured to provide status updates at predetermined time intervals. Further, in some examples, the controller circuit 128 detects when the mobile device 900 enters the network, and in response to this detection, provides a status update of one or more components to be presented on the display screen 902 via the software application. Further still, the software application may be operable to provide various other types of user-interface screens and elements that allow a user to control the robot 100, such as shown and described in U.S. Patent Publication 2014/0207282, and US Patent Publication 2014/0207280, the entireties of which are herein incorporated by reference.

While this specification contains many specific details, these should not be construed as limitations on the scope of the disclosure or of what may be claimed, but rather as descriptions of features specific to particular implementations of the disclosure. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multi-tasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Accordingly, other embodiments are within the scope of the following claims.

What is claimed is:

1. An autonomous cleaning robot, comprising:

a drive configured to automatically drive an entirety of the autonomous cleaning robot across a floor surface;

a cleaning head assembly positioned to engage the floor surface while the autonomous cleaning robot is maneuvered by the drive; and a controller circuit coupled to a sensor and configured to detect an indication of friction caused by an interaction between the cleaning head assembly and the floor surface, and to alter a cleaning characteristic of the autonomous cleaning robot based on the indication of friction.

2. The autonomous cleaning robot of claim 1, comprising a motor driven vacuum fan configured to provide a suction force that pulls debris into a cleaning bin, wherein the controller circuit is configured to alter the cleaning characteristic including adjusting the suction force of the motor driven vacuum fan based on the indication of friction.

3. The autonomous cleaning robot of claim 2, wherein the controller circuit is configured to:

detect an indication of an increase in friction as the autonomous cleaning robot travels from a first floor surface to a second floor surface; and increase the suction force in response to the detected indication of the increase in friction.

4. The autonomous cleaning robot of claim 2, wherein the controller circuit is configured to:

detect an indication of a decrease in friction as the autonomous cleaning robot travels from a second floor surface to a first floor surface; and decrease the suction force in response to the detected indication of the decrease in friction.

5. The autonomous cleaning robot of claim 2, wherein the controller circuit is configured to alter the cleaning characteristic including adjusting a speed of the motor driven vacuum fan based on the indication of friction.

6. The autonomous cleaning robot of claim 2, comprising a side brush motor configured to drive a side brush to flick debris into a path of the cleaning head assembly, wherein the controller circuit is configured to alter the cleaning characteristic including adjusting a speed of the side brush motor based on the indication of friction.

7. The autonomous cleaning robot of claim 2, wherein:

the cleaning head assembly comprises a cleaning roller rotatably mounted parallel to the floor surface, the cleaning roller driven by a roller motor to contact and agitate the floor surface during cleaning; and the controller circuit is configured to determine a power drawn by the roller motor based on a signal sensed by the sensor, and to detect the indication of friction based on the power drawn by the roller motor.

8. The autonomous cleaning robot of claim 7, wherein the controller circuit is configured to detect an indication of an increase in friction as the autonomous cleaning robot travels from a first floor surface to a second floor surface based on an increase in power drawn by the roller motor.

9. The autonomous cleaning robot of claim 7, wherein the controller circuit is configured to detect an indication of a decrease in friction as the autonomous cleaning robot travels from a second floor surface to a first floor surface based on a decrease in power drawn by the roller motor.

10. The autonomous cleaning robot of claim 7, wherein the controller circuit is configured to recognize a type of the floor surface by determining that the power drawn by the roller motor is within one of a plurality of predetermined ranges of roller motor power values for respective different floor types.

11. The autonomous cleaning robot of claim 7, wherein the controller circuit is configured to recognize a type of the floor surface by comparing the power drawn by the roller motor to a plurality of predetermined probability density functions of roller motor power values for respective different floor types.

12. The autonomous cleaning robot of claim 1, wherein the controller circuit is configured to recognize a type of the floor surface based on the detected indication of friction.

13. The autonomous cleaning robot of claim 12, wherein the controller circuit is configured to:

detect a change in friction indication from a first friction indication to a second friction indication; and determine a change in floor type from a first floor type to a second floor type different from the first floor type based on the detected changes in friction indication.

14. The autonomous cleaning robot of claim 13, wherein the first and second floor types are each selected from a hard floor surface and a soft floor surface.

15. A method of operating an autonomous cleaning robot, comprising:

sensing a signal responsive to friction caused by an interaction between a cleaning head assembly of the autonomous cleaning robot and a floor surface as an entirety of the autonomous cleaning robot automatically traversing the floor surface;

detecting, via a controller circuit, an indication of the friction using the sensed signal; and alter, via the controller circuit, a cleaning characteristic of the autonomous cleaning robot based on the indication of friction.

16. The method of claim 15, wherein altering the cleaning characteristic includes, based on the indication of friction, adjusting a suction force of a motor driven vacuum fan configured to suck debris into a cleaning bin of the autonomous cleaning robot.

17. The method of claim 16, comprising:

increasing the suction force in response to an indication of an increase in friction as the autonomous cleaning robot travels from a first floor surface to a second floor surface; and decreasing the suction force in response to an indication of a decrease in friction as the autonomous cleaning robot travels from the second floor surface to the first floor surface.

18. The method of claim 15, wherein altering the cleaning characteristic includes, based on the indication of friction, adjusting one or more of a speed of a motor driven vacuum fan or a speed of a side brush motor configured to drive a side brush to flick debris into a path of the cleaning head assembly.

19. The method of claim 15, comprising:

based on the sensed signal, determining a power drawn by a roller motor driving a cleaning roller of the cleaning head assembly to contact and agitate the floor surface during cleaning; and detecting the indication of friction based on the power drawn by the roller motor.

20. The method of claim 19, comprising:

detecting an indication of an increase in friction as the autonomous cleaning robot travels from a first floor surface to a second floor surface based on an increase in power drawn by the roller motor; and detecting an indication of a decrease in friction as the autonomous cleaning robot travels from the second floor surface to the first floor surface based on a decrease in power drawn by the roller motor.

* * * * *